United States Patent [19]

Max et al.

[11] Patent Number: 5,005,822

[45] Date of Patent: Apr. 9, 1991

[54] SHEET DELIVERY

[75] Inventors: Reinhold Max, Bad Rappenau-Grombach; Karl-Heinz Filsinger, Wiesloch, both of Fed. Rep. of Germany

[73] Assignee: Heidelberger Druckmaschinen AG, Heildelberg, Fed. Rep. of Germany

[21] Appl. No.: 427,796

[22] Filed: Oct. 27, 1989

[30] Foreign Application Priority Data

Oct. 27, 1988 [DE] Fed. Rep. of Germany ..... 3836571

[51] Int. Cl.[5] ..... B65H 31/04

[52] U.S. Cl. ..... 271/213; 414/789; 414/790.8; 271/189; 271/218

[58] Field of Search ..... 271/189, 213, 218, 220, 271/221; 414/789, 790.7, 790.8

[56] References Cited

U.S. PATENT DOCUMENTS

| | | | |
|---|---|---|---|
| 2,631,038 | 3/1953 | Wood et al. | 271/218 |
| 2,738,973 | 3/1956 | Koch | 271/189 |
| 2,785,894 | 3/1957 | Reinartz | 271/189 X |
| 2,836,418 | 5/1958 | Blattner et al. | 271/189 X |
| 3,683,758 | 8/1972 | Feldkamper | 414/790.7 X |
| 3,966,195 | 6/1976 | Simeth | 271/189 |
| 4,569,622 | 2/1986 | Bulk | 414/789 |
| 4,647,265 | 3/1987 | Uno | 414/790.8 X |

FOREIGN PATENT DOCUMENTS

| | | | |
|---|---|---|---|
| 605130 | 2/1935 | Fed. Rep. of Germany . | |
| 0022249 | 7/1958 | Fed. Rep. of Germany | 271/218 |
| 896064 | 2/1945 | France . | |
| 0861133 | 2/1961 | United Kingdom | 271/189 |

*Primary Examiner*—Joseph E. Valenza
*Assistant Examiner*—James R. Bidwell
*Attorney, Agent, or Firm*—Herbert L. Lerner; Laurence A. Greenberg

[57] ABSTRACT

Delivery for sheets being delivered by a transport system in a conveying direction from a sheet-processing machine and being deposited alternatively in a pile and on catching arms of a catching device, the catching arms being temporarily movable out of a basic position into a catching position above the pile, including stops for respective leading edges of the sheets, the stops being disposed at the pile and being flappable away from the pile in the conveying direction, and a transmission system for moving the catching arms from the basic position into the catching position and from the catching position into the basic position, and for flapping-out the stops against the action of a stop spring in the conveying direction and into a release position thereof and in an opposite direction into a stop position on the pile by way of a common actuating element, the transmission system being constructed so as to flap out the stops into the release position immediately after the catching arms have been moved into the catching position, has a dead-center spring swivellable with respect to a swivel shaft and articulatingly connected to the transmission system, the dead-center spring, in a first end position of the transmission system, holding the catching arms in the basic position against the action of at least one tension spring and, in a second end position of the transmission system, holding the stops in the release position thereof against the action of the stop spring.

7 Claims, 1 Drawing Sheet

SHEET DELIVERY

Figure 1:
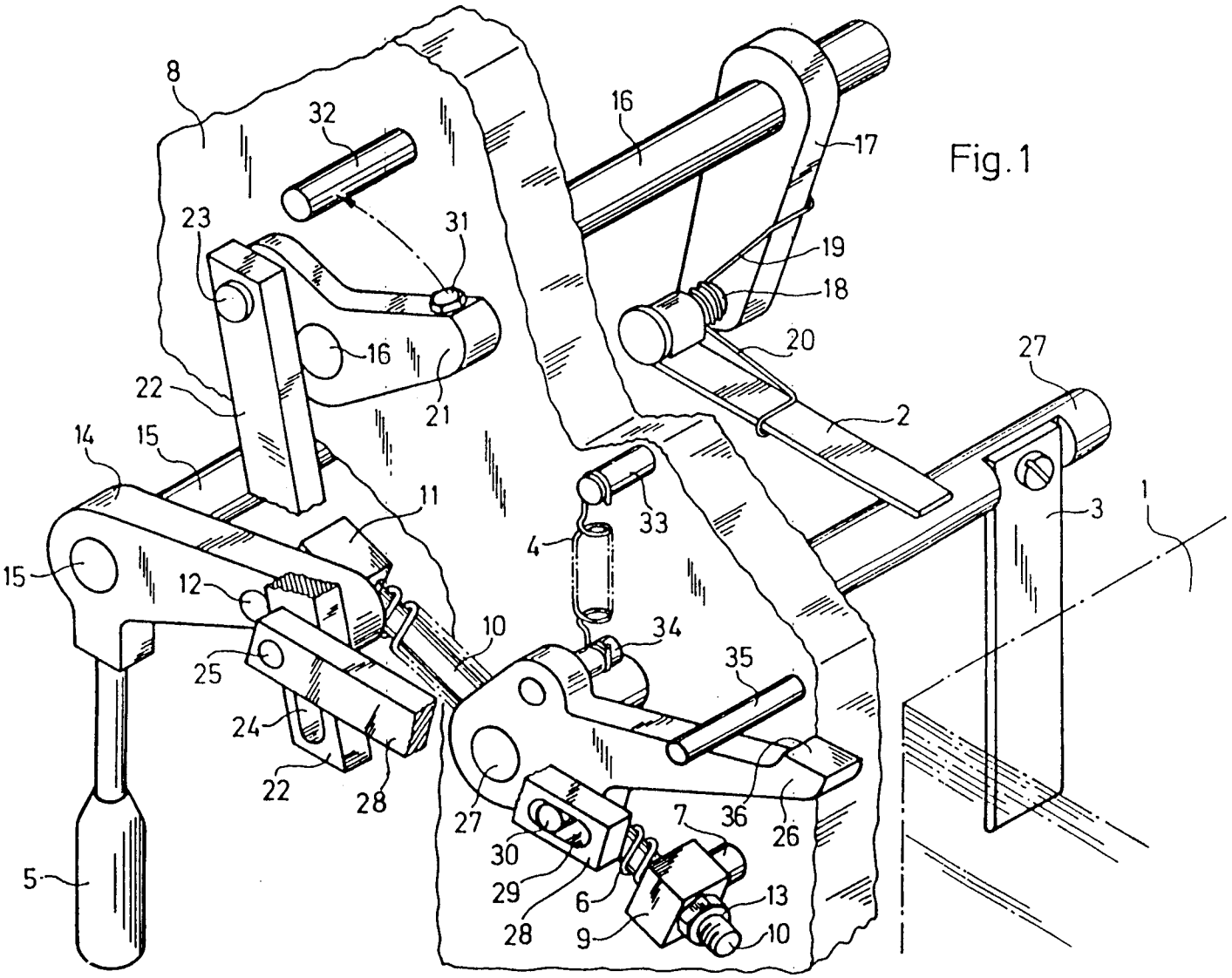

The invention relates to a delivery for sheets, and more particularly to sheets delivered by transport means in a conveying direction from a sheet-processing machine and being deposited alternatively in a pile and on catching arms of a catching device, the catching arms being temporarily movable out of a basic position into a catching position above the pile, including stops for respective leading edges of the sheets, the stops being disposed at the pile and being flappable away from the pile in the conveying direction, and a transmission system for moving the catching arms from the basic position into the catching position and from the catching position into the basic position, and for flapping-out the stops against the action of a stop spring in the conveying direction and into a release position thereof and in an opposite direction into a stop position at the pile by means of a common actuating element, the transmission system being constructed so as to flap out the stops into the release position immediately after the catching arms have been moved into the catching position.

Such a delivery has become known heretofore from German Patent 23 01 840, wherein at least the stops are to be held in their release position by means of a manual force against the action of a stop spring while, in an embodiment according to FIGS. 4 and 5 of that publication, a sheet-catching device is automatically held in the basic position and in the catching position. For this purpose, however, pneumatic adjusting and switching means in the form of pneumatic cylinders, and appropriate control means in the form of a cam disc are provided, in addition to a lever arrangement.

In an embodiment without these additional means, a manual force has to be applied in order to hold both the stops in their release position against the action of the stop spring as well as the sheet-catching device in its catching position against the action of a further spring. In order to remove a test sheet from the pile, therefore, an operator has only one hand free and, depending upon the required restoring forces of the aforementioned springs, must possibly, with the other hand, simultaneously produce a by no means inconsiderable operating force in order to remove a test sheet.

It is accordingly an object of the invention, therefore, to provide a sheet delivery of this general kind which is of relatively simple construction and relatively easy to operate.

With the foregoing and other objects in view, there is provided, in accordance with the invention, a delivery for sheets being delivered by transport means in a conveying direction from a sheet-processing machine and being deposited alternatively in a pile and on catching arms of a catching device, the catching arms being temporarily movable out of a basic position into a catching position above the pile, including stops for respective leading edges of the sheets, the stops being disposed at the pile and being flappable away from the pile in the conveying direction, and a transmission system for moving the catching arms from the basic position into the catching position and from the catching position into the basic position, and for flapping-out the stops against the action of a stop spring in the conveying direction and into a release position thereof and in an opposite direction into a stop position on the pile by means of a common actuating element, the transmission system being constructed so as to flap out the stops into the release position immediately after the catching arms have been moved into the catching position, comprising a dead-center spring swivellable with respect to a swivel shaft and articulatingly connected to the transmission system, the dead-center spring, in a first end position of the transmission system, holding the catching arms in the basic position against the action of at least one tension spring and, in a second end position of the transmission system, holding the stops in the release position thereof against the action of the stop spring.

In a delivery according to the invention, the transmission system is automatically held in both end positions thereof. The removal of a test sheet from the pile is thus considerably facilitated. In order to move the transmission system from one end position thereof into the other, it is not necessary, in any instance, to overcome the full effective force of one of the provided springs by means of an appropriate manual force at the actuating element, because the dead-center spring thereby counteracts either the tension springs or the stop spring. The ease of operation achieved with the invention, therefore, results also from the fact that only small forces are required at the actuating element in order to move the transmission system into its end position. This, moreover, permits the convenient removal of a test sheet within an extremely short space of time.

In an embodiment of a delivery according to the invention, the transmission system is in the form of a simple lever drive, which is suitable, on the one hand, for moving the catching arms and, on the other hand, for flapping or swinging out the stops. If the transmission system is actuated by means of a manually operable actuating element, it is possible, in particular, to dispense with pneumatic adjusting and switching means in order to ensure that at least some transmission parts remain automatically in an end position. If a higher degree of automation is required, however, the actuating element may also be operated by means of a servodrive. In the case of manual operation of the actuating part, a delivery according to the invention does not, however, require any connection whatsoever between it and control lines or energy-supply lines, with the overall result that a delivery of relatively simple construction is obtained, which is then also extremely reliable in operation.

In accordance with other features of the invention, the delivery includes a crank rocker arm articulatingly connected to the dead-center spring, the crank rocker arm being swivellable by the actuating element, the crank rocker arm having an articulating connection with another rocker arm, the connection having a first limited dead travel, the catching arms being movable by the other rocker arm into the catching position and into the basic position, the crank rocker arm having another articulating connection with a stop lever, the connection having a second limited dead travel, the stops being flappable out by the stop lever into the release position and into the stop position. In an extremely simple manner, there then results an active connection, on the one hand, between the actuating element and the catching device and, on the other hand, between the actuating element and the stops, and actuation may be effected by a simple throw of a handle.

In accordance with a further feature of the invention, the first-mentioned articulating connection is formed by a first link swivel-connected at one end thereof to the other rocker arm and formed at the other end thereof with a first slot extending in longitudinal direction of the first link and being engaged by a crank pin of the crank rocker arm, and the other articulating connection is formed by a second link swivel-connected at one end thereof to the crank pin of the crank rocker arm, and formed at the other end thereof with a second slot extending in longitudinal direction of the second link and being engaged by an entrainer pin connected to the stop lever.

A particularly compact construction, especially of the catching device, is afforded, in accordance with an additional feature of the invention, by providing a delivery wherein the other rocker arm is firmly connected to a rocker shaft firmly connected, in turn, to catching levers, the catching arms being swivel-connected, respectively, to the catching levers and being slidably braced, the tension springs being in the form of leg springs and being disposed, respectively, between the catching levers and the catching arms swivel-connected thereto, and having a tendency to turn the rocker shaft for effecting movement of the respective catching arms into the catching position thereof.

In order to ensure the pretensioning both of the tension springs as well as of the stop spring in each of the end positions of the transmission system, there is provided, in accordance with an added feature of the invention, a delivery wherein the other rocker arm, in the catching position of the catching arms, is biased by the tension springs against a first stopper, and the stop lever, in the stop position of the stops, is biased by the stop springs against a second stopper.

Additional means for slidably bracing the catching levers may be dispensed with by providing, in accordance with yet another feature of the invention, a delivery wherein the catching arms are slidably braced on a stop shaft fixed against rotation relative to the stop lever and to the stops.

In accordance with a concomitant feature of the invention, the second slot is disposed so that, when the transmission system is in the first end position thereof, the stop lever is swivellable at least through a relatively small angle for flapping out the stops towards the release position thereof. The delivery according to the invention can thus also be used in conjunction with means for imparting a swivelling movement to the stops for straightening out a side of the pile assigned to the stops.

Other features which are considered as characteristic for the invention are set forth in the appended claims.

Although the invention is illustrated and described herein as embodied in a sheet delivery, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing, which is a perspective view of a transmission system of a sheet delivery for a sheet-processing machine.

Transport means by which sheets are delivered in a conveying direction from a sheet-processing machine are not shown in the drawing in the interest of clarity. Such transport means are known, however, from the aforementioned German Patent 23 01 840, for example.

Referring now more specifically to the figure of the drawing, there is shown therein an embodiment of a transmission system of a sheet delivery according to the invention, shown in a first end position wherein sheets are deposited on a pile 1 shown in phantom. Only a single arm 2 of the plurality thereof which are disposed across the width of the pile 1 transversely to the sheet conveying direction is shown in the drawing in the interest of simplicity and clarity. With the transmission system in the first end position thereof shown in the drawing, each catching arm 2 assumes a basic position, and is temporarily movable by the transmission system out of that basic position into a non-illustrated catching position above the pile 1. This catching position of the catching arms 2 is assumed in a second end position of the transmission system.

Likewise, there is shown in the drawing only one stop 3 of a plurality of stops which are disposed across the width of the pile 1 transversely to the conveying direction for engaging respective leading edges of the sheets.

With the transmission system in the illustrated first end position thereof, each stop 3 assumes a stop position at the pile 1 and is flappable or swingable in the sheet-conveying direction out of the stop position by the transmission system against the action of a stop spring 4 and into a release position. The release position of each stop 3 is likewise assumed in the second end position of the transmission system. The movement of each catching arm 2 and the flapping or swinging out of each stop 3 are effected by a common actuating element 5.

As explained hereinafter, the transmission system is constructed so that the flapping-out of each stop 3 into the release position thereof is effected immediately after each catching arm 2 has been moved into the catching position thereof.

In the figure of the drawing, the association of such a transmission system with a first side wall 8 of a delivery is clearly shown, the side wall 8 being disposed opposite a first side of the pile 1. A similar association may also be implemented with respect to a non-illustrated second side wall which is located opposite a second side of the pile 1.

A dead-center spring 6 is articulatingly connected to the transmission system, and is swivellable with respect to a swivel shaft 7. In the illustrated embodiment, the swivel shaft 7 is mounted in the side wall 8 of the delivery. At an end thereof projecting out of the side wall 8, the swivel shaft 7 carries a first bracing part 9 through which there extends, transversely to the longitudinal axis of the swivel shaft 7, one end of a guide shaft 10 of the dead-center spring 6, which is in the form of a helical spring. The other end of the guide shaft 10 is fastened to a second bracing part 11 which, in turn, is articulatingly connected to the transmission system by hinge pin 12 which is disposed parallel to the swivel shaft 7. The dead-center spring 6 is clamped between the first bracing part 9 and the second bracing part 11. The dead-center spring 6 has an installation length which is adjustable by means of a nut 13 which is screwed onto a thread formed on the one end of the guide shaft 10 which extends through the first bracing part 9, so that the dead-center spring 6 is installable with adjustable pretensioning.

The articulating connection of the dead-center spring 6 is provided on a crank rocker arm 14 of the transmission system. The crank rocker arm 14 is firmly connected to the actuating element 5 and is swivellable with respect to a horizontal crank shaft 15 disposed transversely to the sheet conveying direction. For this purpose, the crank shaft 15 is mounted in at least one side wall 8. For reasons of obtaining improved clarity, the drawing shows only a part of the first side wall 8 and, in particular, a broken-away part through which the crank shaft 15 extends.

A rocker shaft 16 is rotatably mounted parallel to the crank shaft 15 in each side wall 8. As viewed in the sheet conveying direction, the rocker shaft 16 is disposed behind the pile 1 and is respectively connected to a catching lever 17 so as to be fixed against rotation relative thereto, the catching lever 17 being operatively associated with a respective catching arm 2, which is swivel-connected to the respective catching lever 17. With the transmission system in the first end position thereof represented in the drawing, the catching arms 2, as viewed in the sheet-conveying direction, are likewise disposed behind the sheet pile 1 and, in the illustrated embodiment, are slidably supported at an end thereof facing towards the sheet pile 1 on a stop shaft 27, which is discussed in greater detail hereinbelow.

Between each catching lever 17 and each catching arm 2, there is a tension spring 18, in the form of a so-called leg spring having a first leg 19 which is braced against the catching lever 17, and a second leg 20 which is braced against the catching arm 2 so that forces exerted by the respective tension springs 18 have a tendency to turn the rocker shaft 16 with the effect of moving the catching arms 2 into the catching position thereof wherein the catching arms 2 are pushed above the pile 1 in a direction opposite to the sheet-conveying direction.

With the transmission system in the first end position thereof shown in the drawing, the catching arms 2 are held in the basic position against the action of the tension springs 18 by means of the dead-center spring 6. For this purpose, the rocker shaft 16 is connected to a rocker arm 21 so as to be fixed against rotation relative thereto, and a first articulating connection of the crank rocker arm 14 to the rocker arm 21 is provided, so that the rocker arm 21 can be swivelled by the crank rocker arm 14 in a first and in a second and opposite direction whereby, through the intermediary of the rocker shaft 16 and the catching levers 17 fixed against rotation relative thereto, the catching arms 2 are moved into the catching position and into the basic position, respectively.

With the transmission system in the first end position thereof shown in the drawing, the dead-center spring 6, through the intermediary of the crank rocker arm 14 and its first articulating connection with the rocker arm 21, exerts a torque (in clockwise direction in the drawing) on the rocker shaft 16 while a torque is exerted in counterclockwise direction on the rocker shaft 16 because of the tendency of the tension springs 18 to turn the rocker shaft 16 with the effect of moving the catching arms 2 into the catching position thereof. This counterclockwise torque is produced by the bracing of the catching arms 2 on the stop shaft 27, due to the tendency of the tension springs 18 to increase the angle between the first leg 19 and the second leg 20 of the respective tension spring 18 and due to the tendency resulting therefrom of the respective catching lever 17 to perform a counterclockwise swivelling motion with respect to the longitudinal axis of the rocker shaft 16.

With appropriate coordination of the dead-center spring 6 and the tension springs 18, the hereinaforementioned, mutually counteracting torques on the rocker shaft 16 are cancelled out with the result that, with the transmission system in the first end position thereof, the catching arms 2 are held in the basic position by means of the dead-center spring 6 against the action of the tension springs 18.

The hereinaforementioned first articulating connection of the crank rocker arm 14 to the rocker arm 21 is effected by a first link 22 which, at one end thereof, is swivel-connected to the rocker arm 21 by another hinge or articulating pin 23 and, at the other end thereof, is formed with an oblong hole or slot 24, which extends in the longitudinal direction of the first link 22, wherein a crank pin 25 of the crank rocker arm 14 engages. The clockwise torque acting on the rocker shaft 16 results from the dead-center spring 6 bringing the crank pin 25 into contact with the upper end of the first oblong hole 24, as shown in the figure of the drawing, and, consequently, the first link 22 acts as a slider-type connecting rod on the hinge pin 23.

In addition to the first articulating connection of the crank rocker arm 14 to the rocker arm 21, the crank rocker arm 14 has a second articulating connection with a stop lever 26. This stop lever 26 is connected to a stop shaft 27 so as to be fixed against rotation relative thereto, the stop shaft 27 being likewise parallel to the crank shaft 15 and being rotatably held in the side walls 8 of the delivery. The stops 3 are connected to the stop shaft 27 so as to be fixed against rotation relative thereto and, with the transmission system in the first end position thereof shown in the drawing, are in the stop position. In the illustrated embodiment, the flapping or swinging out of the stops 3 into the release position thereof is effected by the clockwise rotation of the stop shaft 27 by means of the stop lever 26, which is connected to the stop shaft 27 so as to be fixed against rotation relative thereto. The stop lever 26 is turned in this direction by means of the second articulating connection of the crank rocker arm 14 to the stop lever 26. This second articulating connection is established by a second link 28, which, on the one hand, is swivel-connected to the crank pin 25 of the crank rocker arm 14 and, on the other hand, is formed with a second oblong hole or slot 29 which extends in the longitudinal direction of the second line 28 and wherein a driver or entrainer pin 30 connected to the stop lever 26 engages.

In order to move the transmission system into the second end position thereof, a swivelling motion of the crank rocker arm 14 in a clockwise direction with respect to the longitudinal axis of the crank shaft 15 is performed by means of the actuating element 5. This swivelling motion permits the tension springs 18 to turn the rocker shaft 16 in a counterclockwise direction and thus move the catching arms 2 into the catching position.

As mentioned hereinbefore, the transmission system is constructed in a manner that the flapping or swinging out of the stops 3 into the release position thereof occurs immediately after the catching arms 2 have been moved into the catching position. This becomes evident if one follows the hereinaforementioned swivelling motion of the crank rocker arm 14 on its path from the first end position into the second end position of the transmission system.

After passing through a first phase of this swivelling motion, a stop part 31 of the rocker arm 21 is disposed in contact with a first stopper 32 which, in the illustrated embodiment, is in the form of a pin mounted in the side wall 8. Immediately after the first phase of the swivelling motion of the crank rocker arm 14, a limited first dead travel formed by the first oblong hole or slot 24 in the first articulating connection between the crank rocker arm 14 and the rocker arm 21 permits the crank rocker arm 14 to swivel farther to the second end position of the transmission system without any effect on the catching arms 2 because, during this further swivelling, the crank pin 25 is able to travel towards the lower end of the first oblong hole 24, as shown in the drawing. In this regard, however, the first link 22 is swivelled only with respect to the hinge pin 23.

A limited second dead travel formed by the second oblong hole or slot 29 in the second articulating connection between the crank rocker arm 14 and the stop lever 26 has the converse effect that, during the hereinaforementioned first phase of the swivelling motion of the crank rocker arm 14 towards the second end position of the transmission system, the second link 28 does not exert any effect upon the stop lever 26; rather, the second oblong hole or slot 29 travels only with respect to the driver or entrainer pin 30 and the right-hand end of the oblong hole or slot 29, as viewed in the figure, does not reach the entrainer pin 30 until the crank rocker arm 14 has swivelled out beyond the hereinaforementioned first phase of the swivelling motion.

At the instant of time at which the hereinaforementioned right-hand end of the second oblong hole or slot 29 reaches the entrainer pin 30, the catching arms 2 are already in the catching position and, from the hereinaforementioned instant of time on, as the crank rocker arm 14 swivels further, the stop lever 26 is swivelled against the action of the stop spring 4 with the effect of flapping or swinging out the stops 3 into the release position. In the illustrated embodiment, this stop spring 4 is in the form of a tension spring and is hooked, at one end thereof, onto a pin 33 mounted in the side wall 8 and, at the other end thereof, onto a further pin 34 secured in the stop lever 26. This further pin 34 is disposed at such a spacing from the longitudinal axis of the stop shaft 27 that the stop spring 4 exerts upon the stop lever 26 a counterclockwise torque, as viewed in the figure, which is counteracted by a clockwise torque acting upon the stop lever 26 when, during the hereinaforementioned further swivelling of the crank rocker arm 14 beyond the hereinaforementioned first phase of the swivelling motion of the crank rocker arm 14, the right-hand end of the second oblong hole or slot 29, as viewed in the figure, is in contact with the entrainer pin 30.

During the swivelling motion of the crank rocker arm 14 from the first end position into the second end position of the transmission system, the dead-center spring 6 passes through its dead-center position when the hinge pin 12 is on a line connecting the centers of the crank shaft 15 and the swivel shaft 7. With the hinge pin 12, as shown in the drawing, located in a position above the dead-center position, thus, especially, with the transmission system in the first end position, the dead-center spring 6 counteracts the tension springs 18 until the stop part 31 engages the first stopper 32. With the transmission system in the first end position thereof, the forces exerted, on the one hand, by the tension springs 18 and, on the other hand, by the dead-center spring 6 are, in particular, so matched with one another that the transmission system is held in the first end position by the dead-center spring 6.

After the stop part 31 has come into engagement with the first stopper 32, the tension springs 18 no longer exert any effect upon the crank rocker arm 14 during the hereinaforementioned further swivelling. Thereafter, and with the hinge pin 12 in the drawing located in a position below the dead-center position of the dead-center spring 6, the dead-center spring 6 acts against the action of the stop spring 4 until the crank pin 25 engages the lower end of the first oblong hole or slot 24, as viewed in the figure, i.e. especially with the transmission system in the second end position thereof. With the transmission system in the second end position thereof, the forces exerted, on the one hand, by the dead-center spring 6 and, on the other hand, by the stop spring 4 are especially matched to one another, once again, in a manner that the transmission system is held in the second end position thereof by means of the dead-center spring 6.

Due to the fact that both the tension springs 18, as well as the stop spring 4, exert forces which counteract the dead-center spring 6, less manual force overall is required in order to bring the transmission system, by means of the actuating element 5, into its respective end positions, in which it then automatically remains, as explained hereinbefore.

The stop position of the stops 3 is defined or determined by a second stopper 35 in the form of a pin secured in the side wall 8, with which the stop lever 26 is in contact when the transmission system is in the first end position thereof.

In the illustrated embodiment, due to the special construction of the second oblong hole or slot 29 and of a control surface 36 of the stop lever 26, the transmission system is constructed for the use of the delivery with a device for straightening out the side of the sheet pile 1 defined or limited by the stops 3. The control surface 36 may, for this purpose, for example, cooperate with a non-illustrated control cam, which causes, at the stop lever 26, periodic deflections through relatively small swivel angles against the action of the stop spring 4. These deflections have no further effect, however, for example, on the position of the catching arms 2, because these deflections merely cause the entrainer pin 30 to travel within the second oblong hole or slot 29 which, with the transmission system in the first end position thereof, extends to both sides of the entrainer pin 30 and causes only swivelling movements of the second link 28 about the crank pin 25 when the stops 3 are flapped or swung out through relatively small swivel angles towards the release position thereof.

The foregoing is a description corresponding in substance to German Application P 38 36 571.5, dated Oct. 27, 1988, the International priority of which is being claimed for the instant application, and which is hereby made part of this application. Any material discrepancies between the foregoing specification and the aforementioned corresponding German application are to be resolved in favor of the latter.

We claim:

1. Delivery for sheets being delivered by transport means in a conveying direction from a sheet-processing machine and being deposited alternatively in a pile and on catching arms of a catching device, the catching arms being temporarily movable out of a basic position into a catching position above the pile, including stops for respective leading edges of the sheets, the stops being disposed at the pile and being flappable away from the pile in the conveying direction, and a transmission system for moving the catching arms from the basic position into the catching position and from the catching position into the basic position, and for flapping-out the stops against the action of a stop spring in the conveying direction and into a release position thereof and in an opposite direction into a stop position on the pile by means of a common actuating element, the transmission system being constructed so as to flap out the stops into the release position immediately after the catching arms have been moved into the catching position, comprising a dead-center spring swivellable with respect to a swivel shaft and articulatingly connected to the transmission system, said dead-center spring, in a first end position of the transmission system, holding the catching arms in the basic position against the action of at least one tension spring and, in a second end position of the transmission system, holding the stops in the release position thereof against the action of the stop spring.

2. Delivery according to claim 1, including a crank rocker arm articulatingly connected to the dead-center spring, said crank rocker arm being swivellable by the actuating element, said crank rocker arm having an articulating connection with another rocker arm, said connection having a first limited dead travel, the catching arms being movable by said other rocker arm into the catching position and into the basic position, said crank rocker arm having another articulating connection with a stop lever, said connection having a second limited dead travel, the stops being flappable out by said stop lever into the release position and into the stop position.

3. Delivery according to claim 2, wherein said first-mentioned articulating connection is formed by a first link swivel-connected at one end thereof to the other rocker arm and formed at the other end thereof with a first slot extending in longitudinal direction of said first link and being engaged by a crank pin of said crank rocker arm and said other articulating connection is formed by a second link swivel-connected at one end thereof to said crank pin of said crank rocker arm, and formed at the other end thereof with a second slot extending in longitudinal direction of said second link and being engaged by an entrainer pin connected to said stop lever.

4. Delivery according to claim 2, wherein said other rocker arm is firmly connected to a rocker shaft firmly connected, in turn, to catching levers, the catching arms being swivel-connected, respectively, to said catching levers and being slidably braced, said tension springs being in the form of leg springs and being disposed, respectively, between said catching levers and the catching arms swivel-connected thereto, and having a tendency to turn said rocker shaft for effecting movement of the respective catching arms into the catching position thereof.

5. Delivery according to claim 2, wherein said other rocker arm, in the catching position of the catching arms, is biased by said tension springs against a first stopper, and said stop lever, in the stop position of the stops, is biased by said stop springs against a second stopper.

6. Delivery apparatus according to claim 4, wherein the catching arms are slidably braced on a stop shaft fixed against rotation relative to said stop lever and to the stops.

7. Delivery apparatus according to claim 3, wherein said second slot is disposed so that, when the transmission system is in said first end position thereof, said stop lever is swivellable at least through a relatively small angle for flapping out the stops towards the release position thereof.

* * * * *